United States Patent [19]

Kamio

[11] 4,185,219

[45] Jan. 22, 1980

[54] TUBULAR INCANDESCENT LAMP

[75] Inventor: Nobuyuki Kamio, Yokosuka, Japan

[73] Assignee: Tokyo Shibaura Denki Kabushiki Kaisha, Kawasaki, Japan

[21] Appl. No.: 919,835

[22] Filed: Jun. 28, 1978

[30] Foreign Application Priority Data

| | | | |
|---|---|---|---|
| Jul. 4, 1977 | [JP] | Japan | 52-79041 |
| Jul. 11, 1977 | [JP] | Japan | 52-81924 |
| Jul. 21, 1977 | [JP] | Japan | 52-86699 |
| Jul. 22, 1977 | [JP] | Japan | 52-87273 |

[51] Int. Cl.[2] ..... H01K 1/18

[52] U.S. Cl. ..... 313/279; 313/273; 313/316

[58] Field of Search ..... 313/279, 271–274

[56] References Cited

U.S. PATENT DOCUMENTS

| | | | |
|---|---|---|---|
| 3,189,778 | 6/1965 | Brundige | 313/279 X |
| 3,194,999 | 7/1965 | Heinlein | 313/279 X |
| 3,538,374 | 11/1970 | Kane | 313/279 X |
| 3,760,217 | 9/1973 | Martin et al. | 313/279 X |
| 3,943,395 | 3/1976 | Huston et al. | 313/273 |

*Primary Examiner*—Alfred E. Smith
*Assistant Examiner*—Charles F. Roberts
*Attorney, Agent, or Firm*—Cushman, Darby & Cushman

[57] ABSTRACT

A tubular incandescent lamp comprises an elongated tubular envelope and a filament assembly disposed longitudinally extending in the tubular envelope by means of ring-like anchors. The filament assembly comprises a plurality of coil-shaped filaments, subcoils coupled with the filaments and connectors formed by strand wires. The ends of the connector are fitted into the subcoils and fixed therein.

11 Claims, 21 Drawing Figures

TUBULAR INCANDESCENT LAMP

This invention relates to a tubular incandescent lamp with a filament assembly having radiant and non-radiant portions being longitudinally and axially arranged in the tubular lamp in alternate fashion.

Various tubular incandescent lamps of such a type have been developed and put into practice. One of them is a tubular halogen lamp used for an exposure light source in an electronic copying machine.

The tubular halogen lamp of this type is formed by a silica glass tube having therein a coil-shaped filament assembly in which radiant portions and non-radiant portions are alternately arranged along the length of the glass tube, in order to obtain a uniform distribution of radiation over an entire length of the tube. Ring anchors or loop anchors hold the filament assembly stretching longitudinally and substantially axially along the tube. As seen from FIGS. 1 and 2, a connector 2 of a metal bar with a high melting point and a given length is inserted into a part of the coil 1 of the filament, the outer diameter of connector being substantially equal to the inner diameter of the coil. The connector thus inserted shortcircuit the parts of the filaments 1 where are in contact with the connectors to partly prevent radiation of the filaments. As a result of the prevention of radiation, the radiation distributes uniformly over an entire length of the tube. The connectors are disposed so as to prevent the connectors from moving in axial direction of the tube. In other words, the connectors are previously so positioned as to provide uniform incandescing of the filaments 1. For this, dislocation of the connectors in the tube axial direction destroys the uniformity of incandescing particularly at the ends and the middle of the lamp.

Therefore, the axial movement of the connectors 2 must possibly or completely avoided. Nevertheless, it frequently takes place. One of the countermeasures thus far taken for this is to calk the filaments 1 with the connectors 2. In another countermeasure, the connector 2 is provided with a depression 4 formed normal to the length of it. A pair of the filament 1 is distorted and pinched around the depression 4.

The countermeasures have been almost successful in preventing the axial displacement of the connectors. However, the calking and pinching are followed by scratches on the filament at the scratched or pinched portion. However, excessive distortion of the filament plastic-deforms the filament so that the filament is easily broken. This leads to frequent and undesirable snapping of the filament 1. Further, the outer diameter of the connector 2 is approximate to the inner diameter of the filament coil to impede the movement of the connector within the coil. Accordingly, the connector must be prepared for every size of the filament coil. In other words, many kinds of connectors must be prepared. The use of the heavier connector than the filament renders the filament tend to yield. Therefore, the incandescent lamp is easily affected by vibration and the weight of the tube itself is increased.

Additionally, in manufacturing the connectors, necessary are that the diameter of the connector is approximately 1 mm at most, that a metal bar used for the connector must have a high melting point, and that working of it needs a high precision. The finished connector tends to be broken at the depression. For this reason working of it is very difficult, thus resulting in poor yield.

Accordingly, an object of the invention is to provide a tubular incandescent lamp completely eliminating a need for groove-working of connectors.

Still another object of the invention is to provide a tubular incandescent lamp allowing easy fixing of the connectors.

According to one aspect of the invention, there is provided a tubular incandescent lamp comprises an elongated tubular envelope and a filament assembly extending longitudinally in the envelope, said filament assembly including a plurality of coil-shaped filaments, subcoils coupled with the filaments, connectors of strand wires and ring-shaped anchors wound around the connectors to support the extending filament assembly in the envelope, wherein the ends of the connectors are fitted into the subcoils and then the subcoils with the connector ends are pressed from outside of fix them.

The strand wire is formed by stranding two or more wire elements. At least one of the wire elements may has a diameter different from the remaining ones.

According to another aspect of the invention, there is provided a tubular incandescent lamp comprises an elongated tubular envelope and a filament assembly extending longitudinally in the envelope, said filament assembly including a plurality of coil-shaped filaments, subcoils coupled with both ends of the filament, connectors each including a strand wire having at least two wire elements and ring-shaped anchors to support the extending filament assembly in the envelope, wherein the ends of the connectors are fitted into the subcoils and then the subcoils with the connector ends fitted are tightly wound by the anchors, thereby to simultaneously fix the connectors, the subcoils and the anchors.

In the just-mentioned construction, the subcoils coupled with both ends of the filament are different in length. Further, the top ends of the connector preferably pass through the subcoils. Furthermore, the anchors may tightly be wound around the subcoils and the connectors outside the subcoils as well. In the constructions of the first and second aspects, desirable is that the top ends of the connector pass through the subcoils and that each top end passing through the subcoil is apart at least 0.2 mm from the end of the filament confronting the top end of said connector.

According to still another aspect of the invention, there is provided a tubular incandescent lamp comprises an elongated tubular envelope, a coil-shaped filament extending longitudinally in the envelope and a plurality of connectors coaxially and separately disposed in the filament coil, each connector including a strand wire, and ring-shaped anchors for tightly winding the connectors through the filament to fix the connectors in the filament coil and to support the filament coil longitudinally extending in the envelope, whereby the connectors each shortcircuit a pair of the filament coil in contact with said connector to prevent light-emission from said part.

Other objects and features of the invention will be apparent from the following description taken in connection with the accompanying drawings, in which.

Figure 6A:
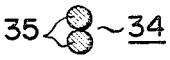
Figure 6B:
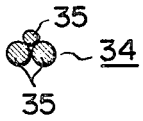
Figure 6C:
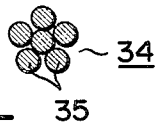
Figure 6D:
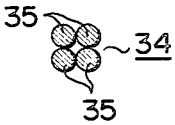
Figure 6E:
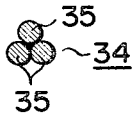
Figure 7A:
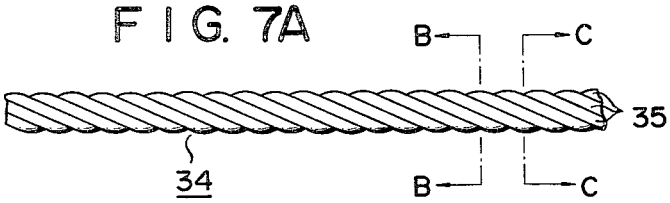
Figure 7B:
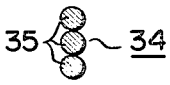
Figure 7C:
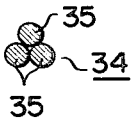
Figure 8:
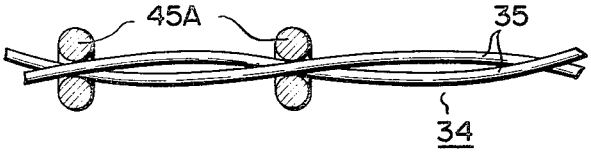
Figure 9:
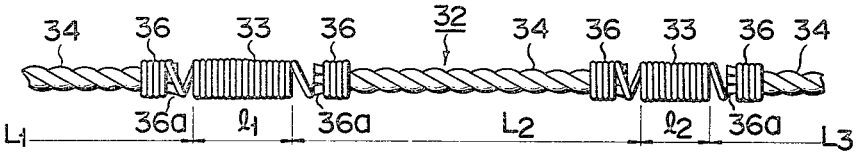
Figure 10:
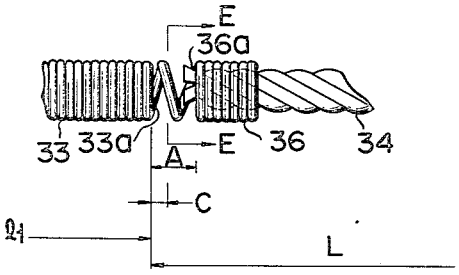
Figure 11:
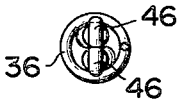
Figure 12:
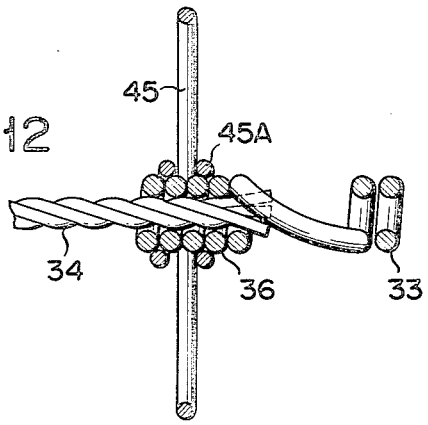
Figure 13:
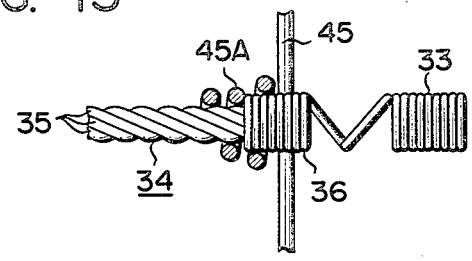
Figure 14:
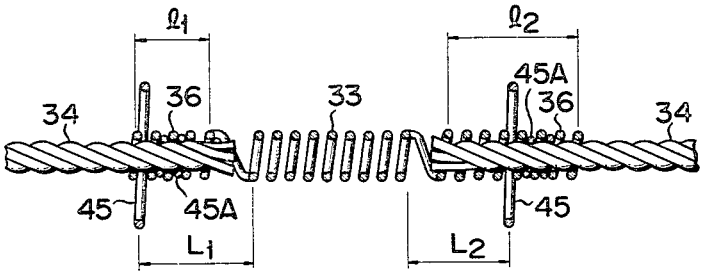
Figure 15:
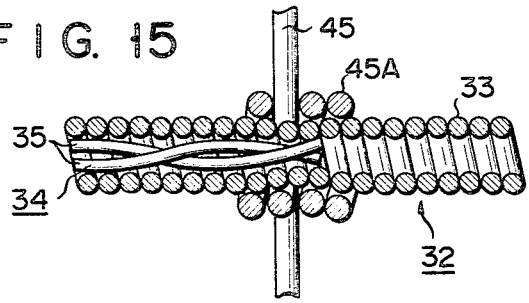

FIGS. 6(A) to 6(E) show a set of transverse cross sectional views of connectors comprising strand wires used in the incandescent lamp according to the invention;

FIG. 7(A) shows a side view of the connector in FIG. 6(E);

FIGS. 7(B) and 7(C) show cross sectional views taken along the lines B—B and C—C;

FIG. 8 shows an enlarged view of the connector in FIG. 6(A) pressed by ring-shaped anchors;

FIG. 9 shows a side elevation partly in section of a tubular incandescent lamp which is another embodiment according to the invention;

FIG. 10 is an enlarged view of a part of the incandescent lamp in FIG. 9;

FIG. 11 shows a cross sectional view taken along the line E—E in FIG. 10;

FIG. 12 shows a cross sectional view of a part of the incandescent lamp of the invention, illustrating a coupling state of a subcoil, a connector and a ring-shaped anchor; and FIGS. 13 to 15 show side elevational cross sections of major parts of other embodiments of the incandescent lamps according to the invention.

Figure 1:
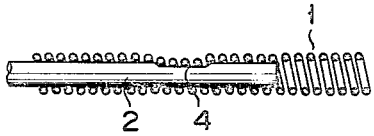
FIG. 1 PRIOR ART
FIGS. 1 and 2 show fragmentary sectional views of a conventional tubular incandescent lamp.
Figure 2:
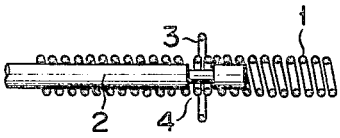
FIG. 2 PRIOR ART
Figure 3:
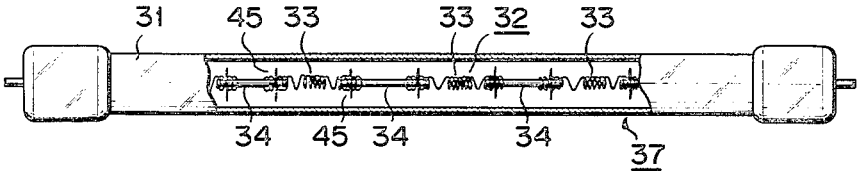
FIG. 3 shows an elevation partly in section of a tubular incandescent lamp according to the invention, illustrating the interior of the incandescent lamp by partly cutting away the envelope of the lamp.
Figure 4:
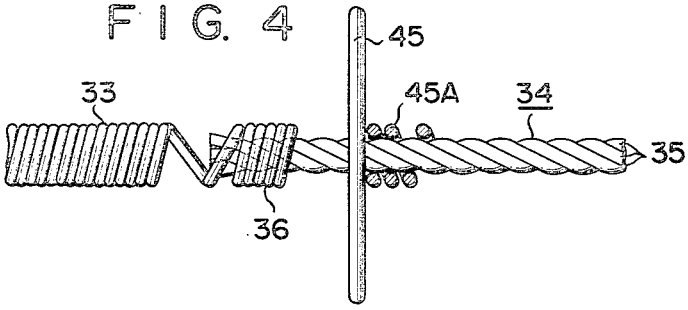
FIGS. 4 and 5 show the enlarged details of the view in FIG. 3.

To illustrate an embodiment a tubular incandescent lamp according to the invention, reference is now made to FIGS. 3 and 4. As shown, a tubular envelope 31 of quartz glass is hermetically sealed by pinching both ends of it, with a filament 32 included therein extending longitudinally and substantially axially of the envelope 31. The filament 32 comprises filament elements 33 and connectors 34 each connecting adjacent filament elements 33. As shown in FIG. 4, the connector 34, which is a strand wire composed of three wire elements twisted, is inserted at the ends into subcoils 36 of the adjacent filament elements 33. As shown, the subcoils 36 is formed at both ends of each filament element 33. As seen from the figures, the connector 34 is preferably passed through the subcoil 36 in a manner that the ends of the connectors are slightly projected from the end faces of the corresponding subcoils. Then, the subcoils with the ends of the connectors thus inserted are partly pinched from exterior to fix the subcoils to the connectors. The winding section 45A of the ring-shaped anchor 45 winds a part of the connector 34, while the remaining part thereof radially extends to form a loop-like configuration as a circular enlarged section which is disposed close to the inner wall of the envelope 31 and substantially coaxial with the envelope 31. The envelope 31 is filled with inert gas such as argon, and halogen.

The tubular incandescent lamp 37 thus constructed according to the invention can attain its aimed objects. As mentioned above, the filament assembly 32 comprises filament elements 33 with subcoils 36 at both ends and connectors 34, those being alternately arranged in a series. The connector 34, which is formed by a twisted stand wire, waves at the surface and such a wave surface is very convenient for fixing the filament elements 33. Generally, when a part of the strand wire with the waving surface is squeezed normal to its length, the adjacent remaining parts warp to radially extend. Accordingly, in such a case, only the sqeezed part of the strand wire is narrowed to block movement of the filament element 33 thereat.

Accordingly, the narrowed part as well as the waving surface of the strand wire may effectively be used to lock the filament element and the connector 34. The waving surface is formed by twisting two or more wires and not by machining. Therefore, this waving surface formation is applicable for slender connectors, thus resulting in an extensive application. As mentioned above, the conventional connector is machine worked to form a groove for locking the filament coil. On the other hand, the surface of the connector, or strand wire, gently waves along the length of it. This indicates that there is no need for machining the connector to narrow the diameter of it, unlike the conventional one. In addition, two or more wires stranded are used for the connector. For this, the mechanical strength of the connector according to the invention is improved. Further, the connector portion is radially enlarged in diameter to press against the inner surface of the subcoil 36, thereby to increase friction resistance between the connector and the subcoil. The increased friction resistance also assists in locking the connector relative to the subcoil.

Figure 5:
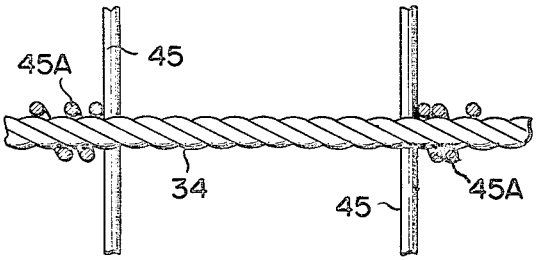

Turning now to FIG. 5, there is illustrated a case where the ring anchors are previously attached to the connector comprising a strand wire. This case is advantageous in that the connector with anchors may be manufactured in mass production. The connector and anchor set is useful in assembling the filament 33 by fixing it to the subcoils of the filament elements. Advantages of this example is that the mass production of the filament assemblies is possible and therefore the manufacturing cost it reduced, and that easy assembling of them is possible and thus the product quality is improved.

FIG. 6 illustrates in cross sectional strand wires, which are used as connectors 34, composed of two to six wire elements, respectively.

In the case of a strand wire including two wire elements as shown in FIG. 6A, for a subcoil with a fixed coil diameter, the diameter of the strand wire may be set to about $\frac{1}{2}$ of that of the subcoil. Therefore, this type strand wire is firm, and has open pitch with steep curving of the surface. Accordingly, the fixing of the ring anchor to the filament element is facilitated. Further, because of the open pitch, it has much pitch space and this means its weight is light, with the result that, when it is assembled into the filament assembly, no excessive load is applied to the filament assembly. In the case of the strand wire including three wire elements, it is resistive to its deformation or distortion, thus providing a stable connector.

When a strand wire including four or more wire elements is used for the connector, for a given diameter of the filament coil, the diameter of each wire element may be reduced so that its manufacturing is easy, and electric resistance of it is small. As a result of the reduction of the electric resistance, no light is emitted from this part of the filament assembly and hence good distribution of radiation by the filament assembly is secured.

In case where one of the wire elements constituting a strand wire is smaller in diameter than the remaining ones, the irregularity of the surface is amplified due to the use of the narrower wire element. The diameter of the narrower wire element is preferably 0.4 to 0.8 times that of the remaining ones.

It is desirable to use tungsten for the wire elements; however, other suitable metal such as molybdenum may be used.

Reference is now made to FIG. 7 illustrating a connector 34 comprising a strand wire including three wire elements 35. As shown, the cross section taken along the line B—B has three wire elements arranged in a series and the cross section taken along the line C—C has a wire element arrangement of triangle. Such an arrangement of wire elements is very convenient for fixing the anchors 45 to the filament elements 33. As exaggeratedly illustrated in FIG. 8, tightening the strand wire by the wire portion 45A of the ring anchor 45 causes the wire elements 35 at the tightened part thereof to align in a series, while causing the wire elements at the remaining part to warp radially and outwardly.

When the outer diameter of the strand wire is selected so as to fall within the range 0.9 to 0.8 times the inner diameter of the coil, the strand wire may smoothly be inserted into the subcoil and surely be fixed to the same. To obtain a reliable fixing, the coupling portion of the strand wire with the filament subcoil must be approximately 0.2 mm long.

As shown in FIG. 5, in attaching the ring anchors 45 to the connector 34, when the ring anchors 45 are disposed with equal intervals axially along the filament assembly 32, the filament assembly thus assembled has a good vibration proof. Preferably, the wire 45A of the ring anchor 45 is thicker than the filament wire. In either case, two or more turns of the wire is necessary for ensuring the fixing.

It is desirable that the ring anchors 45, when being fixed, are disposed with equal distances apart from the ends of the filament elements 33. In an unavoidable case, the distances must be minimized.

Referring now to FIG. 9, there is shown another embodiment of the tubular incandescent lamp according to the invention. In the figure, a filament assembly 32 is comprised of subcoils 36, filament elements 33 and connector 34. As shown, both end parts of each connector 34 are inserted into the adjacent subcoils to an extent that the ends are slightly projected from the end face of the subcoils 36, respectively. In such a condition, the connector 34 and the subcoil 36 are fixedly coupled, with the result that connectors 34 and the filament elements 33 are alternately arranged in a series to form a filament assembly. In this case, the length $l_2$ of the filament element 33 disposed at the central part of the filament assembly is short and the length $l_1$ of it is longer as the filament element is disposed closer to the ends of the filament assembly. With such an arrangement of the filament element, a substantially uniform distribution of radiation is attained over an entire length of the filament assembly. The filament assembly is stretched axially along the envelope (not shown) by ring-shaped anchors 34 (not shown) attached to given portions of the connectors 34. Note here that the end of the connector 34 lies in the space A between the end face 36*a* of the subcoil 36 and the end face 33*a* of the filament element 33 and that end of the connector is distance 0.2 mm or more from the end face 33*a* of the filament element 33, i.e., in the figure, the distance C is 0.2 mm or more. Otherwise, if the end of the connector 34 reaches the end face 33*a* of the filament 33, heat energy necessary radiation of the filament element 33 is transmitted to the connector 34, with the result that radiation from the filament elements is deteriorated. Conversely, when the end of the connector fails to project from the end face of the subcoil, the shortcircuiting of the subcoil by the connector is insufficient so that the subcoil is partly heated to radiate light. For this, the illumination distribution of the lamp is deteriorated and the heated subcoil is frequently etched by halogen material. The construction shown in FIG. 10 overcomes such disadvantages. Further, as shown in FIG. 11, the end of the connector 34 projecting from the subcoil 36 may be crushed to form a flat portion 46. In this case, the intervals $L_1$, $L_2$ . . . between adjacent filament elements can be precisely set to facilitate its assembling work so that the performance of the lamp is improved and aging of it is little.

Reference is not to FIG. 12 illustrating still another embodiment of the tubular incandescent lamp according to the invention. In this example, the connector 34 is comprised of a strand wire including twisted three wire elements and has an outer diameter of approximately 1.0 mm $\phi$. Attachment of the connector 34 to the filament element 33 is made in a manner that one end of the connector 34 is inserted into the subcoil 36 and the inserted part of the subcoil is squeezed by the winding part 45A of the ring like anchor 45. When the squeezing force of the winding part 45A or external force is applied around the subcoil with the connector end inserted, the strand wire inserted is partly deformed to be flat and top end thereof radially and outwardly warps. Thus, the strand wire is fitted into the subcoil to prevent the strand wire from slipping off. In this case, selecting the outer diameter of the connector 0.95 to 0.8 times the inner diameter of the subcoil ensures a reliable fitting thereof.

As shown in FIG. 13, the winding part 45A of the ring anchor 45 may wind around the subcoil 36 and a part of the connector 34. This method further improves the coupling of the subcoil 36 of the filament element 33 with the connector 34. Also in this case, the top end of the connector 34 is inserted into the subcoil 36, with a slight projection from the end surface of the subcoil 36, the pinching around the subcoil warps the projected end of the connector radially and outwardly, thus preventing the connector from slipping off.

The connector 34 is comprised of a strand wire with the outer surface waving axially along the filament element. When the wind part of the ring anchor 45 tightly winds around the subcoil 36 with the strand wire 35, the strand wire within the subcoil is squeezed to be narrowed in diameter while the strand wire outside the subcoil expands its diameter. Thus, the connector 34 is prevented from moving in the axial direction of the connector. Furthermore, if the subcoil slightly apart from the projection of the connected end is tightly wound by the ring anchor, the projection end of the connector radially turns aside from the axial direction of the connector, and presses against the inner surface of the subcoil. As a result, the top end of the strand wire is put in at the pitch of the coil, contacting with the end surface of the subcoil. Since the connector is previously formed by bundling a plurality of narrow wires so as to have the diameter in accordance with the inner surface of the subcoil, it is easy to construct the connector so as to fit the inner diameter of the subcoil.

In FIG. 14, illustrating a further embodiment of the invention, a filament assembly 32 comprises a series, alternate connection of filament elements 33 and connectors 34, as shown. Thus, radiant sections and non-radiant sections are alternately arranged axially along the filament assembly, thereby providing substantially uniform distribution of radiation over the full length of the filament assembly. The connector 34 is formed by a strand wire including three wire elements. The diameter of the strand wire is approximately 1.0 mm $\phi$. The subcoils, as the fixing portions, of the filament element coupled with the connectors are attached to the ends of the filament element 33 and the lengths $l_1$ and $l_2$ of the subcoils are different ($l_1 < l_2$). The connector is fitted into the subcoil 36. The fitting operation may easily be conducted through helical turning of either one. Then, the winding part 45A of the ring anchor 45 winds around the outersurface of the subcoil thereby simultaneously fixing the connector 34, the subcoil 36 and the ring like anchor 45. In this case, the distances $L_1$ and $L_2$ from the filament element 33 to the ring anchor 45 are selected so as to be substantially equal. The equal distance equalizes the temperatures at both ends of the filament element, thus resulting in no deterioration of the radiation characteristic. Note here that, in FIG. 14, the winding portions 45A wound around both subcoils 36 of the filament element 33 are arranged in the same direction. This is advantageous in that the winding operation of the anchor is easy. Conversely, those winding portions 45A may be arranged in opposite direction. To secure easy and reliable fixing, it is desirable to select the outer diameter of the connector 0.8 to 0.95 times the inner diameter of the subcoil.

An additional embodiment of the invention shown in FIG. 15 similarly includes a filament assembly 32 stretched longitudinally and axially along a quartz glass envelope. A connector 34 comprising a strand wire composed of wire elements 35 is inserted into a part of a filament element 33. Thus, the filament assembly 32 comprises radiative sections and non-radiative sections. A part of the ring anchor 45 is tightly wound around the filament element 33 so that the filament element 33, the connector 34 and the ring anchor 45 are simultaneously fixed. The tightly winding of the ring anchor causes a part of the strand wire constituting the connector to radially warp, thereby to prevent the movement of the connector and the ring anchor. Therefore, undesirable displacement of the radiative portions of the filament assembly is removed thus being followed by little aging.

As described above, the tubular incandescent lamp with such constructions enables the connector position to be immovable within the lamp.

Accordingly, the radiative sections and non-radiative sections of the filament assembly may fixedly be located at given positions so that the radiation contour obtained is uniform. The strand wire used for the connector has spaces among the filament element. For this, the connector is light in weight and this minimizes the sagging of the filament assembly. Additionally, unexpected useful effects also follow such as it is resistive for vibration and distortion. Further, the irregularity on the outer surface of the connector may readily be formed by merely twisting two or more wire elements. This considerably improves work of the irregularity surface formation, and this method is suitable for manufacturing of small connectors rejecting machineworking for irregularity formation.

What we claim is:

1. A tubular incandescent lamp comprising an elongated tubular envelope and a filament assembly extending longitudinally in said envelope and including a plurality of coil-shaped filaments, subcoils coupled with said filaments, connectors of strand wires and ring-shaped anchors wound around said connectors to support said extending filament assembly in said envelope, wherein the ends of said connectors are fitted into said subcoils and then said subcoils with said connector ends fitted are pressed from outside to fix them.

2. A tubular incandescent lamp according to claim 1, in which said strand wire is formed by stranding two or more wire elements and at least one of said wire elements has a diameter different from the remaining ones.

3. A tubular incandescent lamp comprising an elongated tubular envelope and a filament assembly extending longitudinally in said envelope, said filament assembly comprising a plurality of coil-shaped filaments, subcoils coupled with both ends of said filament, connectors each including a strand wire having at least two wire elements and ring-shaped anchors to support the extending filament assembly in said envelope, wherein the ends of said connectors are fitted into said subcoils and then said subcoils with said connectors fitted are tightly wound by said anchors, thereby to simultaneously fix said connectors, subcoils and anchors.

4. A tubular incandescent lamp according to claim 3, in which said subcoils coupled with both ends of said filament are different in length.

5. A tubular incandescent lamp according to claim 4, in which the lengths of the portions of said connectors inserted into said subcoils are different one another.

6. A tubular incandescent lamp according to claim 3, in which the top ends of said connectors pass through said subcoils.

7. A tubular incandescent lamp according to claim 3, in which the winding portions of said anchors tightly around said subcoils adjacently disposed are arranged in the same direction.

8. A tubular incandescent lamp according to claim 3, in which the winding portions of said anchors tightly wound around said subcoils adjacently disposed are arranged in opposite direction.

9. A tubular incandescent lamp according to claim 3, in which said anchor is tightly wound around said subcoil and said connector outside said subcoil as well.

10. A tubular incandescent lamp comprising an elongated tubular envelope and a filament assembly extending longitudinally in said envelope by means of coil-shaped anchors, said filament assembly including a plurality of coil-shaped filaments, subcoils coupled with said filaments, and connectors which are fitted into said subcoils and each comprised of a strand wire, wherein the top ends of said connector pass through said subcoils and each top end passing through said subcoil is apart from the end of said filament confronting said top end of said connector by the distance of 0.2 mm or more but less than the distance between said filament and said subcoil.

11. A tubular incandescent lamp comprising an elongated tubular envelope, a coil-shaped filament extending longitudinally in said envelope, a plurality of connectors coaxially and separately disposed in the filament coil, each connector including a strand wire, and ring-shaped anchors for tightly winding said connectors through said filament to fix said connectors in said filament coil and to support said filament coil longitudinally extending in said envelope, whereby said connectors each shortcircuit a part of said filament coil in contact with said connector to prevent light-emission from said part.

* * * * *